United States Patent [19]

Beute

[11] Patent Number: 4,927,027

[45] Date of Patent: May 22, 1990

[54] RECLOSABLE CARTON

[75] Inventor: Willem Beute, Zwijndrecht, Netherlands

[73] Assignee: Lever Brothers Company, New York, N.Y.

[21] Appl. No.: 202,174

[22] Filed: Jun. 3, 1988

[30] Foreign Application Priority Data

Jun. 5, 1987 [GB] United Kingdom ..... 8713265

[51] Int. Cl.[5] ..... B65D 5/54

[52] U.S. Cl. ..... 206/611; 206/614; 206/621; 206/626; 229/151; 229/152

[58] Field of Search ..... 206/611, 613, 614, 615, 206/621, 626; 229/151, 152, 149

[56] References Cited

U.S. PATENT DOCUMENTS

| | | | |
|---|---|---|---|
| 637,397 | 11/1899 | Lynch | 229/152 |
| 2,186,109 | 1/1940 | Hultin | 206/621 |
| 2,260,137 | 10/1941 | Donnelly | 229/152 |
| 3,144,195 | 8/1964 | Hennessey | 206/625 |
| 3,301,391 | 1/1967 | Guyer | 206/626 |
| 3,680,766 | 8/1972 | Collura et al. | 206/621 |
| 4,434,896 | 3/1984 | Beloate et al. | 206/621 |

FOREIGN PATENT DOCUMENTS

| | | | |
|---|---|---|---|
| 531201 | 10/1956 | Canada | 206/631 |
| 1722668 | 2/1956 | Fed. Rep. of Germany . | |
| 2838356 | 3/1980 | Fed. Rep. of Germany | 206/611 |
| 2073707 | 10/1981 | United Kingdom | 206/626 |

*Primary Examiner*—Gary Elkins

*Attorney, Agent, or Firm*—Gerard J. McGowan, Jr.

[57] ABSTRACT

One end of a skillet style carton is closed by minor closure flaps (16,17) foldably attached to opposite side walls (3,4), an overlying inner major closure flap (11), preferably adhered to the minor closure flaps, and an outer major closure flap (13) overlying and adhered to the inner major closure flap (11). The carton is opened by tearing to disconnect the inner major closure flap (11) from its respective wall (1) and a tuck flap (14), initially overlying the outside of the carton, is tucked inside the carton on re-closure.

9 Claims, 2 Drawing Sheets

RECLOSABLE CARTON

This invention relates to a reclosable carton formed from a one-piece blank of cardboard or like material.

German Gebrauchsmuster No. 1722668 describes a folding box having at one end major closure flaps connected to the front and back walls and minor closure flaps connected to the opposite side walls. One of the major closure flaps is folded to overly the minor flaps and is provided with a tuck flap which is tucked inside the box. The other, outer, major closure flap is folded over and adhered to the first folded or inner major flap. The box is opened by breaking the folded connection between the outer major flap and the respective wall of the box, the fold line being perforated to assist this action.

According to the present invention there is provided a reclosable carton comprising a front wall, a back wall, and two opposite side walls, minor closure flaps foldably attached to the side walls, an inner major closure flap foldably attached to the front wall overlying the minor closure flaps and an outer major closure flap foldably attached to the back wall overlying and adhered to the inner major closure flap, a tuck flap attached to the outer major closure flap along the edge opposite the connection to the back wall and folded to overlie the front wall, tear means extending across the front wall adjacent to the connection between the front wall and the inner major closure flap.

To open the carton the tear means is used to tear across the front wall thus separating the inner major closure flap from the front wall and allowing the outer major flap to be hinged upwardly along the foldable attachment of the outer major closure flap with the rear wall, the inner closure flap remaining adhered to the underside of the outer major closure flap. The two major closure flaps thus together form a lid hinged to the carton along the fold line connecting the inner major flap to the back wall of the carton. When required the carton can be reclosed with the tuck flap inserted inside the carton behind the front wall, the tuck flap frictionally engaging the inside of the front wall to retain the major flaps in substantially their original positions.

Erection of the carton from a flat blank is easily accomplished. In particular the folding of the end flaps is effected in the usual manner with the simple additional step of the tuck flap to a position overlaying the front wall. When the carton is reclosed the tuck firmly holds the lid in the closed position since the tuck flap is now folded to lie inside the carton.

To facilitate storage and transportation of the carton when filled and closed the tuck flap is preferably releasably secured to the outside of the front wall thus minimising the risk of the tuck flap becoming accidentally attached to or hooked to another carton and also to present a neater appearance to the closed carton.

The tear means can comprise a tear tape, e.g. of plastics material, secured to the inside of the front wall along the direction in which the front wall is to be torn to release the inner major closure flap from the front wall. The tear tape can remove a strip of the front wall, one edge of the strip coinciding with the fold line attachment between the front wall and the inner major closure flap. An alternative form of tear means is a tear strip formed by a line or lines of intermittent perforations extending partly or completely through the thickness of the board material as is well known in the art.

Conveniently the carton can have a joint flange foldably attached to one edge of the front wall and secured to the outside of an adjacent edge of one of the side walls, a grip tab being formed in the joint flange to lie at one end of the tear means. The grip tab provides the user with means for gripping and pulling the tear means to open the carton.

Alternatively the joint flange can be foldably attached to one edge of one of the side walls and be secured to the inside of the adjacent edge of the front wall. The tear means would extend across the front wall in the same way as before to separate the inner major flap from the front wall leaving a gap for insertion of the tuck flap on reclosure. Unless that part of the joint flange adjacent the tear means is modified, i.e. by foreshortening or providing for its removal together with or after using the tear means, the gap for insertion of the tuck flap is reduced and can make re-closure of the carton awkward. In this event the shape of the tuck flap can be modified, i.e. reduced in size at the appropriate position, to facilitate its insertion in the available gap.

To provide a powder tight carton, the inner major closure flap should be a full flap i.e. corresponding in size to the end of the carton. Powder proofness is further improved if the inner major closure flap is secured to the two minor closure flaps. Preferably the inner major closure flap is secured to portions of the minor closure flaps spaced away from the foldable attachment of the minor closure flaps to the side walls, said portions being defined by a line of weakness extending parallel to the foldable attachment of the minor closure flaps. As the major flaps are hinged to first open the container, the minor flaps each tear along the lines of weakness leaving said portions attached to the underside of the inner major closure flap. When the carton is reclosed the remaining portions of the minor closure flaps attached to respective side walls assist in protecting the contents of the carton.

Depending on the size of the carton and the nature of the contents, a carrying handle can be conveniently secured to opposite side walls of the carton. The carrying handle can be used to carry the carton before and after it has been opened.

An embodiment of the invention will now be described with reference to the accompanying diagrammatic drawings in which.

Figure 1:
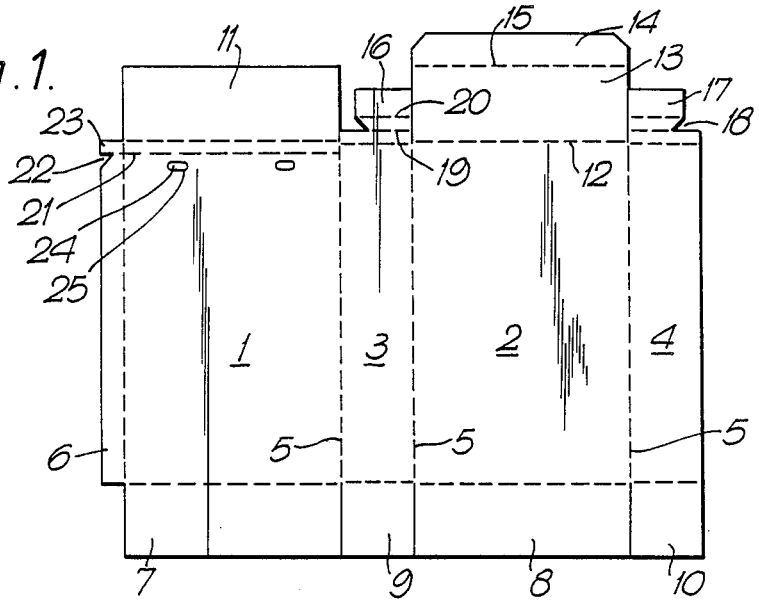
FIG. 1 is a plan view of a carton blank.

Referring to FIG. 1, there is shown a blank for a carton according to the invention as seen from the outside of the blank. The blank is of E flute corrugated cardboard and is suitable for forming a carton to contain contents such as detergent powder weighing in the order of 4 Kg.

As can be seen, the blank is designed to make a carton generally similar to a skillet style carton. The blank comprises a front wall 1, back wall 2 and two opposite side walls 3 and 4, the walls being connected together by fold lines 5. A joint flange 6 is connected to the free end of the front wall 1. At the bottom of the blank are provided major closure flaps 7 and 8 and minor closure flaps 9 and 10 connected by fold lines to the front, back and side walls respectively.

At the top of the blank there is provided an inner major closure flap 11 foldably connected to the front wall 1 along fold line 12. An outer major closure flap 13 is similarly connected to the back wall 2 with a tuck flap 14 foldably attached to the distal edge thereof along fold line 15. Minor closure flaps 16, 17 are foldably connected to the side walls 3 and 4 respectively each having a notch 18, the end of which coincides with a line of perforations 19 in the upper surface of the flap. The underside of the minor closure flaps are also provided with a parallel row of perforations 20 spaced from the row 19.

A tear tape 21 extends across the inner surface of the front wall 1 adjacent the fold line 12 and extends into the joint flange 6. The joint flange is provided with a notch 22 to form a grip tab 23 overlying the tear tape 21. Below the tear tape two areas 24 in the front wall are defined by cut lines 25 extending only partly through the board thickness.

Figure 2:
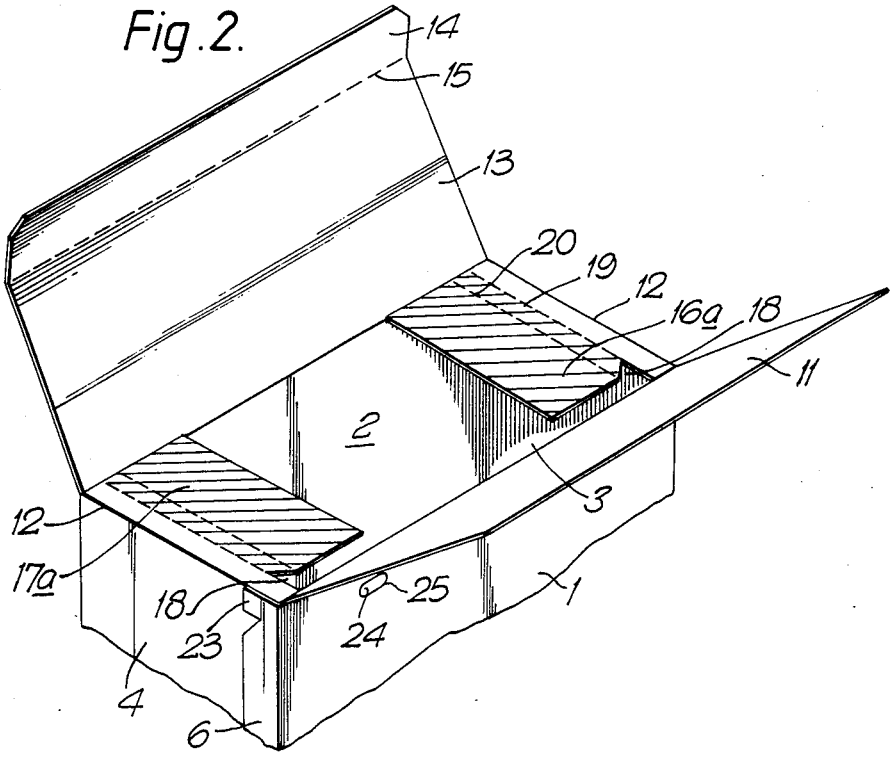
FIG. 2 is a perspective view of the top of a carton partly erected from the blank of FIG. 1.

Referring now to FIG. 2, there is shown the top of the carton in the partially erected condition. This condition is achieved by folding the blank of FIG. 1 through 180° along fold line 5 between the back wall 2 and side wall 4 and along fold line 5 between the front wall 1 and side wall 3, thus bringing the joint flange 6 to overlie side wall 4 to which it is adhered.

The carton can then be squared up and the flaps at the bottom of the carton closed in the usual way before the carton is filled.

To close the top of the carton, the minor flaps 16, 17 are folded along fold line 12 to lie across the end of the carton as shown in FIG. 2. The inner major closure flap 11 is then folded to overlie the minor closure flaps and is adhered to the shaded portions **16*a*, 17*a* thereof. The inner major closure flap 11 extends completely across the top of the carton to the fold line 12 connecting the back wall 2 with the outer major closure flap 13. The outer major closure flap 13 is then folded over and adhered to the inner major closure flap 11 and finally the tuck flap is adhered to the areas 24** of the front wall.

Figure 3:
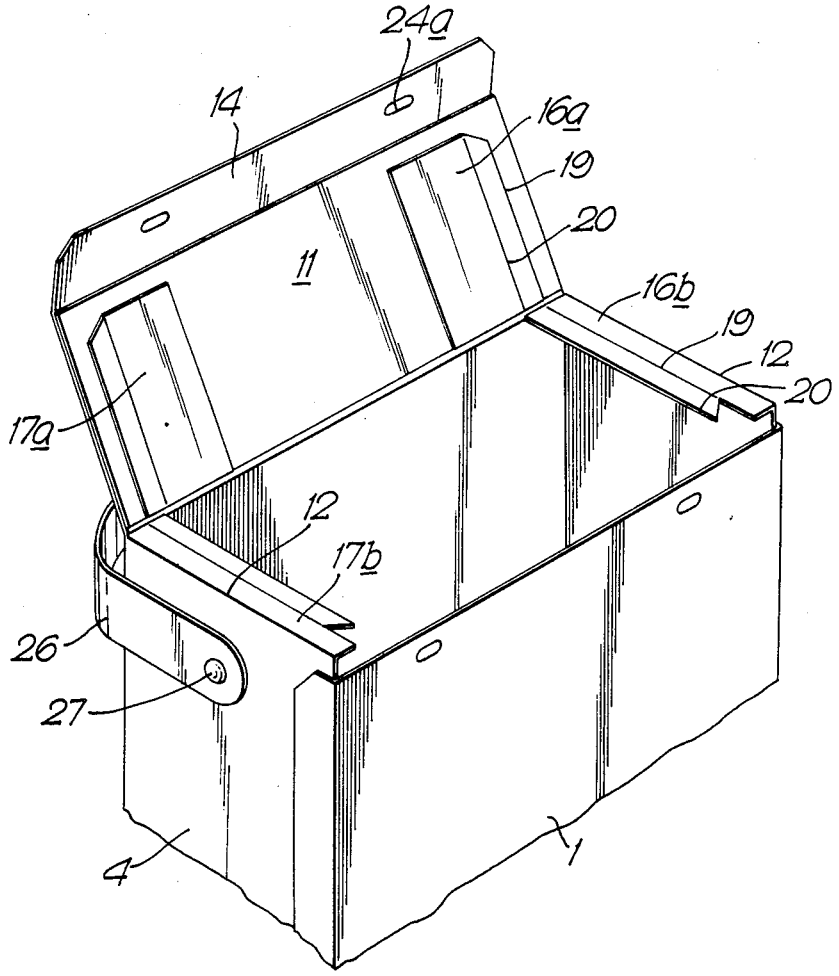
FIG. 3 is a similar perspective view showing the top of the carton after it has been opened.

To open the carton the tuck flap is pulled away from the front wall which is facilitated by the tendency to remove a layer of material **24*a* from the front wall glue areas 24 defined by the cut lines 25. The layer of material 24*a* remains attached to the tuck flap 14 at 24*a* as shown in FIG. 3. The grip tab 23 is then pulled away from the side wall 4 and gripped and pulled so that the tear tape 21 removes a strip of the front wall 1 adjacent the fold line 12. The inner major closure flap is thereby released from its foldable connection with front wall 1. Lifting the outer outer major closure flap 13 together with the inner closure flap 11 adhered thereto can then be effected, this lifting causing the minor closure flaps to tear along the parallel lines of weakness 19 and 20, the material of the minor closure flaps delaminating between the lines of weakness assisted by the notches 18 to leave the shaded portions 16*a*, 17*a* adhered to the underside of the inner major closure flap 11**.

To reclose the carton the remaining portions **16*b*, 17*b* of the minor closure flaps left attached to the side walls 3 and 4 along fold line 12 are positioned as shown in FIG. 3 and the lid formed by the outer major closure flap 13 and the several flaps adhered thereto is folded down and the tuck flap 14 inserted in the carton behind the front wall 1. Any tendency of the lid to open is prevented by frictional engagement of the outside of the tuck flap 14 with the inside of the front wall 1** of the carton.

As shown in FIG. 3, the carton can be readily provided with a handle 26 secured to the side walls. The handle can be of flexible plastics material and secured by rivets 27 so as to be movable from the position shown in FIG. 3 to a position extending across the top of the carton for carrying purposes.

I claim:

1. A reclosable carton comprising a front wall, a back wall, and two opposite side walls, minor closure flaps foldably attached to the side walls, an inner major closure flap foldably attached to the front wall overlying the minor closure flaps and an outer major closure flap foldably attached to the back wall overlying and adhered to the inner major closure flap to form therewith a reclosable lid to the carton, a tuck-flap attached to the outer major closure flap along an edge opposite the connection to the back wall and folded to overlie the front wall, and tear means extending across the front wall adjacent to the connection between the front wall and the inner major closure flap, the tuck flap being insertable within the carton along the tear means to lie behind the front wall and retain the lid in the reclosed position.

2. The carton according to claim 1 in which the inner major closure flap is secured to the minor closure flaps other than to portions adjacent the foldable attachment of the minor closure flaps to the side walls, said portions being defined by a line of weakness extending parallel to the foldable attachment of the minor closure flaps.

3. The carton according to claim 1 wherein a grip tab lies at one end of the tear means.

4. The carton according to claim 2 wherein said grip tab is formed in a joint flange.

5. A carton according to claim 1 in which the tuck flap is releasably secured to the outside of the front wall.

6. A carton according to claim 1 in which the tear means comprises a tear tape secured to the inside of the front wall.

7. A carton according to claim 6 having a joint flange foldably attached to one edge of the front wall and secured to the outside of an adjacent edge of one of the side walls, a grip tab being formed in the joint flange to lie at one end of the tear means.

8. A carton according to claim 1 in which the inner major closure flap corresponds to the size of the end of the carton.

9. A carton according to claim 2 having a carrying handle secured to the opposite side walls.

* * * * *